US007186940B1

(12) United States Patent
Wong

(10) Patent No.: US 7,186,940 B1
(45) Date of Patent: Mar. 6, 2007

(54) ELECTRICAL SWITCH

(75) Inventor: Kin Yu Wong, Hong Kong (HK)

(73) Assignee: Defond Components Limited, Hong Kong (HK)

( * ) Notice: Subject to any disclaimer, the term of this patent is extended or adjusted under 35 U.S.C. 154(b) by 0 days.

(21) Appl. No.: 11/262,941

(22) Filed: Nov. 1, 2005

(51) Int. Cl.
*H01H 13/30* (2006.01)

(52) U.S. Cl. ..... 200/537; 200/522

(58) Field of Classification Search ..... 200/522, 200/534–537, 240, 241, 250, 243, 244, 433–435, 200/437, 447–450
See application file for complete search history.

(56) References Cited

U.S. PATENT DOCUMENTS 6,469,268 B1 * 10/2002 Schaeffeler et al. ..... 200/522
6,664,490 B2 * 12/2003 Kato ..... 200/449
6,717,080 B1 * 4/2004 Chan et al. ..... 200/200
6,784,390 B2 * 8/2004 Chu ..... 200/522

* cited by examiner

*Primary Examiner*—Elvin Enad
*Assistant Examiner*—M. Fishman
(74) *Attorney, Agent, or Firm*—Leydig, Voit & Mayer, Ltd.

(57) ABSTRACT

An electrical switch includes two fixed contacts and a moving contact supported for movement between an ON position in contact with the fixed contacts and an OFF position out of contact with the fixed contacts, and an operating mechanism for moving the moving contact. The operating mechanism has an operating member, a contact mover supported for moving the moving contact upon movement by the operating member, and a spring-loaded device located between the operating member and the contact mover for movement by the operating member past a transitional condition of maximum strain to flick the contact mover between the operating positions of the contact mover.

12 Claims, 4 Drawing Sheets

ELECTRICAL SWITCH

The present invention relates to an electrical switch for controlling the operation of an electrical appliance such as a power tool.

BACKGROUND OF THE INVENTION

Electrical switches especially those for controlling the operation of power tools are designed with care and precision and must meet a variety of official standards and requirements on, inter alia, performance and safety.

The invention seeks to provide a new or otherwise improved electrical switch.

SUMMARY OF THE INVENTION

According to the invention, there is provided an electrical switch comprising a casing, at least one fixed contact and at least one moving contact supported in the casing for movement between an ON position in contact with the fixed contact and an OFF position out of contact from the fixed contact, and an operating mechanism provided in the casing for moving the moving contact between the ON position and the OFF position. The operating mechanism has an operating member supported for movement by a user between an ON position corresponding to the ON position of the moving contact and an OFF position corresponding to the OFF position of the moving contact. Included is a contact mover supported for moving the moving contact upon movement by the operating member between an ON position corresponding to the ON position of the operating member and an OFF position corresponding to the OFF position of the operating member. There is also a spring-loaded device provided between the operating member and the contact mover for movement by the operating member past a transitional condition of maximum strain to thereby flick the contact mover between its ON and OFF positions.

Preferably, the operating member is supported for linear movement in opposite directions.

Further more preferably, the operating member is supported for movement inwardly and outwardly of the casing.

It is preferred that the contact mover is supported for linear movement in opposite directions.

It is further preferred that the operating member is supported for linear movement in opposite directions substantially parallel to the movement of the contact mover.

In a preferred embodiment, the spring-loaded device is adapted to perform an over-center action past the transitional condition of maximum strain therein upon movement by the operating member to flick the contact mover between its ON and OFF positions.

Preferably, the spring-loaded device comprises a spring compressed or stretched between the operating member and the contact mover.

More preferably, the spring-loaded device includes a pivotable link extending across the operating member and the contact mover, the link being acted upon by the spring.

Further more preferably, the spring is flippable across opposite sides of the link through an over-center action past the transitional condition of maximum strain in the spring.

Further more preferably, the link comprises a U-shaped member.

In a first preferred embodiment, the electrical switch includes two said fixed contacts and one said moving contact separate from the fixed contacts, the moving contact being carried by the contact mover for movement into contact with the fixed contacts or out of contact therefrom.

More preferably, the contact mover includes a spring and supports the moving contact under the action of the spring at an inclined position relative to the fixed contacts.

In a second preferred embodiment, the electrical switch includes two said fixed contacts and one said moving contact pivoted upon one of the fixed contacts for rocking movement by the contact mover into contact with the other of the fixed contacts or out of contact therefrom.

More preferably, the contact mover includes a spring-loaded plunger acting upon the moving contact in opposite directions across said one of the fixed contacts.

BRIEF DESCRIPTION OF DRAWINGS

The invention will now be more particularly described, by way of example only, with reference to the accompanying drawings, in which.

DETAILED DESCRIPTION OF PREFERRED EMBODIMENTS

Figure 1:
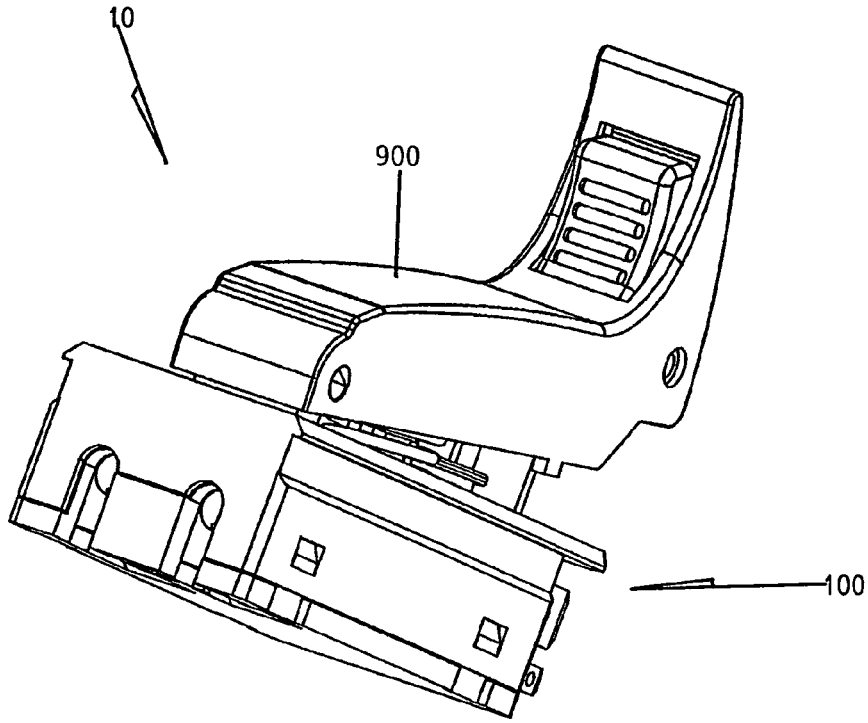
FIG. 1 is an end perspective view of a first embodiment of an electrical switch in accordance with the invention.
Figure 2:
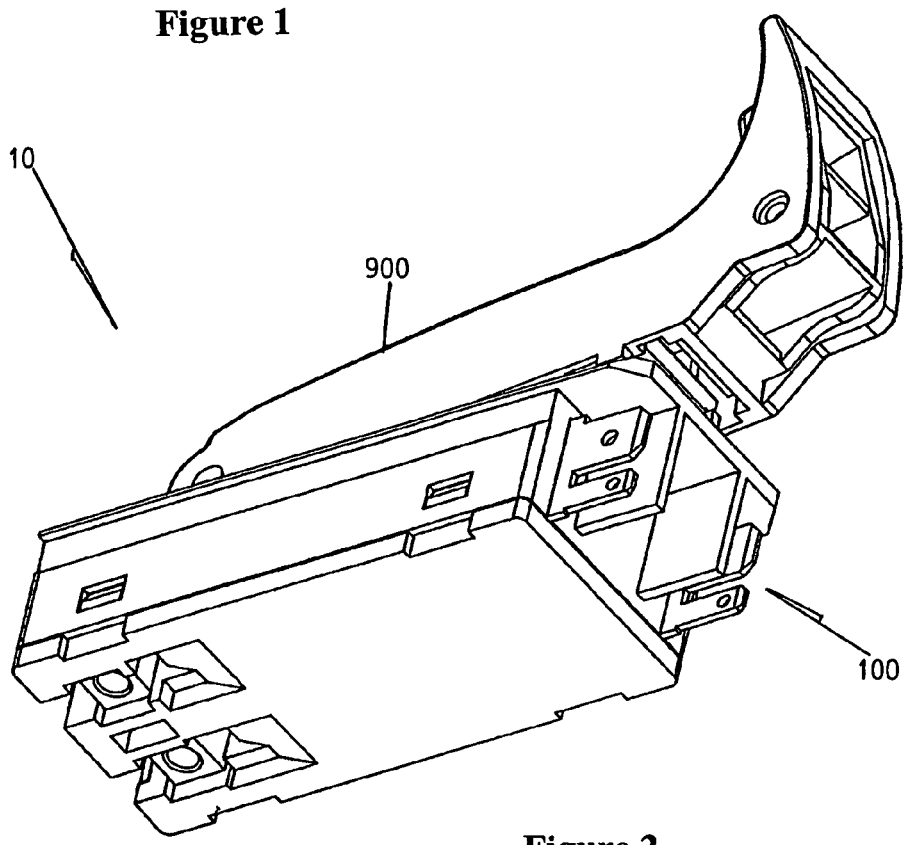
FIG. 2 is a bottom perspective view of the switch of FIG. 1.

Referring initially to FIGS. 1 to 4 of the drawings, there is shown a first electrical switch 10 embodying the invention, which has a base 100 and an operator 900 pivotable thereon. The base 100 has a generally rectangular oblong casing 101 shown lying horizontally, which has opposite front and rear end portions 101A and 101B. The operator 900 extends generally alongside the base casing 101, having a rear end 900B hinged to a hinge block 102 on the rear casing portion 101B and a front end 900A that is crooked outwardly (upwardly).

Figure 3:
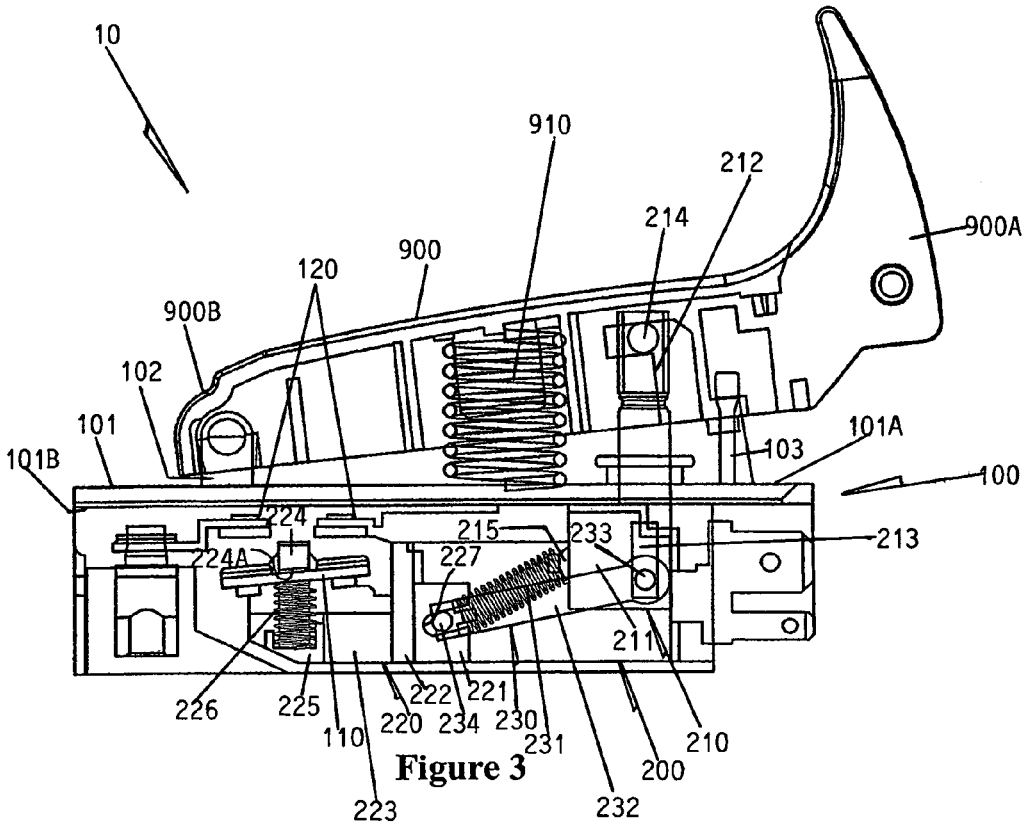
FIG. 3 is a cross-sectional side view of the switch of FIG. 1, in a switched-off condition.
Figure 4:
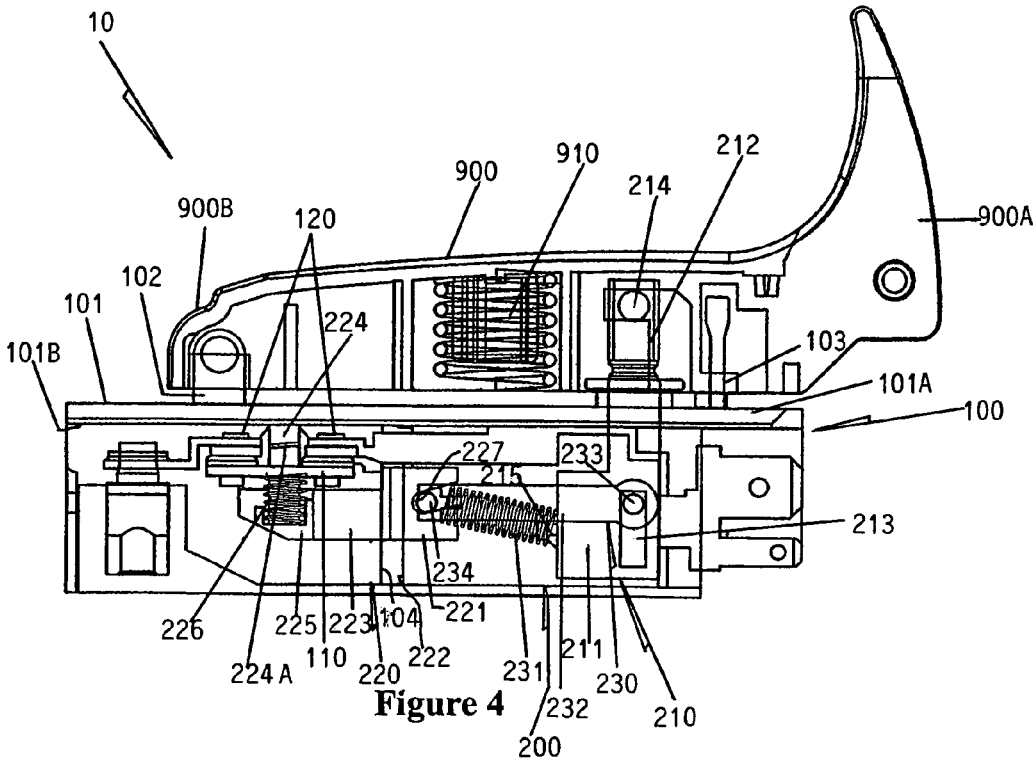
FIG. 4 is a cross-sectional side view corresponding to FIG. 3, showing the switch in a switched-on condition.
Figure 5:
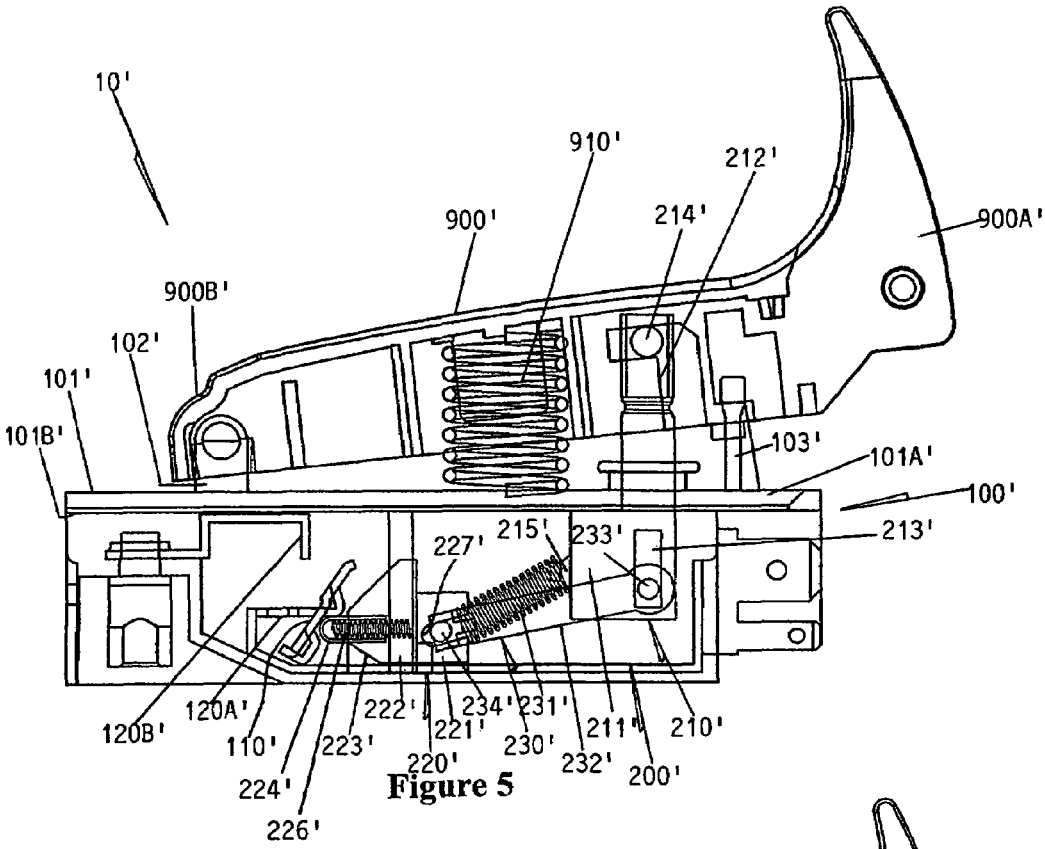
FIG. 5 is a cross-sectional side view of a second embodiment of an electrical switch in accordance with the invention, in a switched-off condition.
Figure 6:
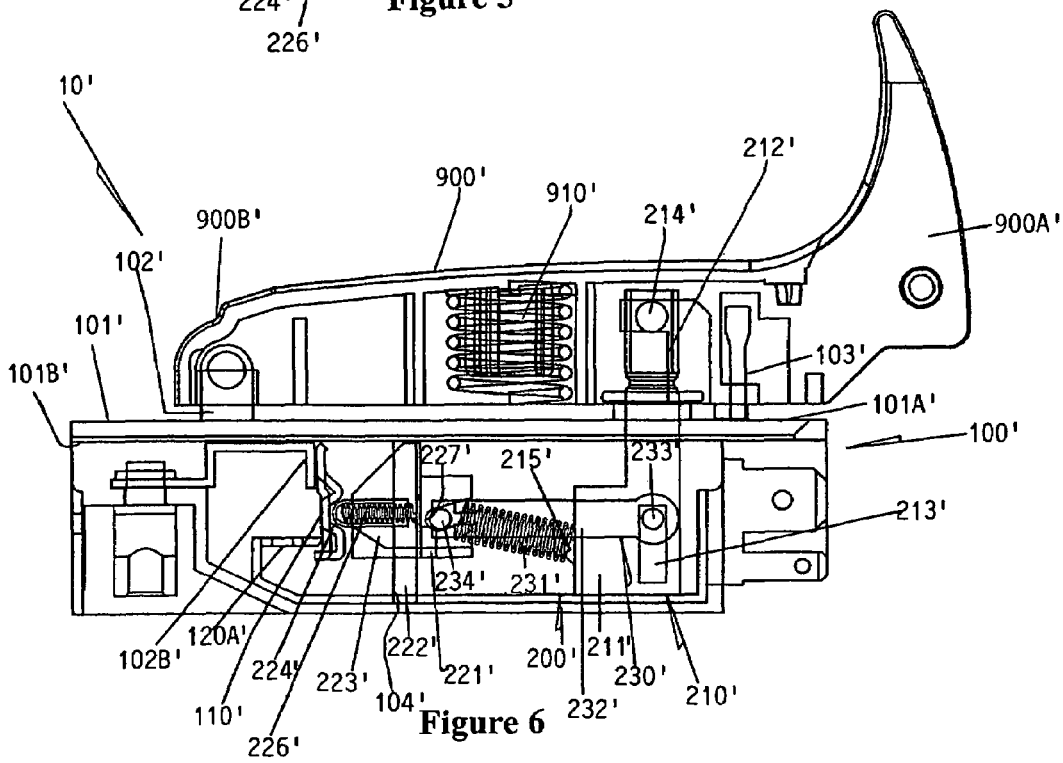
FIG. 6 is a cross-sectional side view corresponding to FIG. 5, showing the switch in a switched-on condition.
Figure 7:
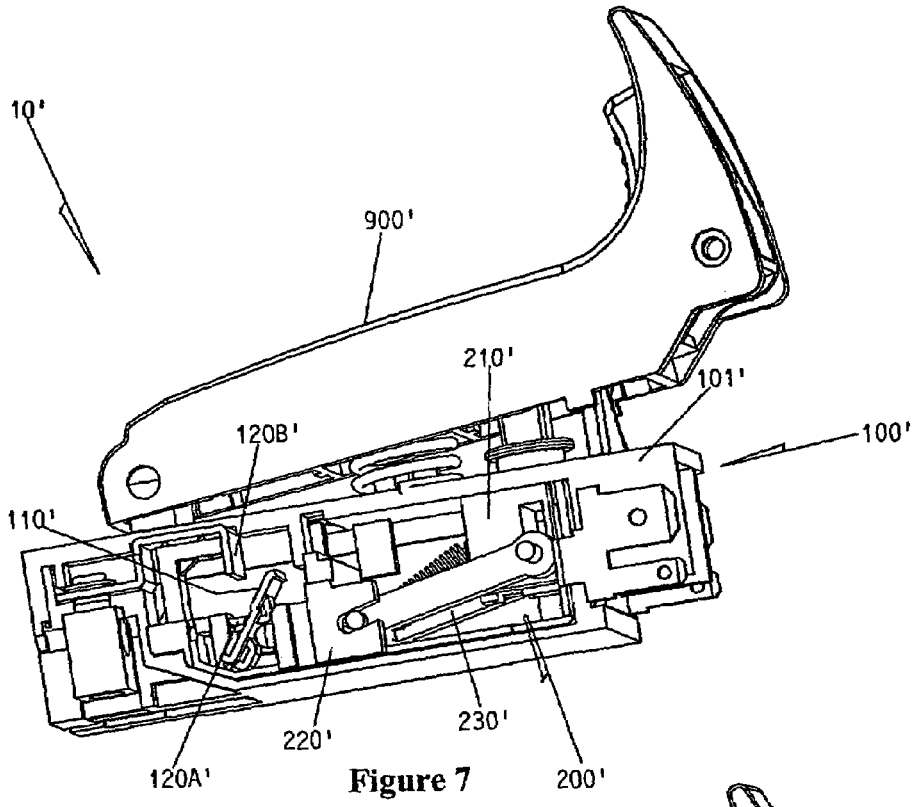
FIG. 7 is a perspective view of the switch of FIG. 5, partially broken to reveal the interior of the switch.
Figure 8:
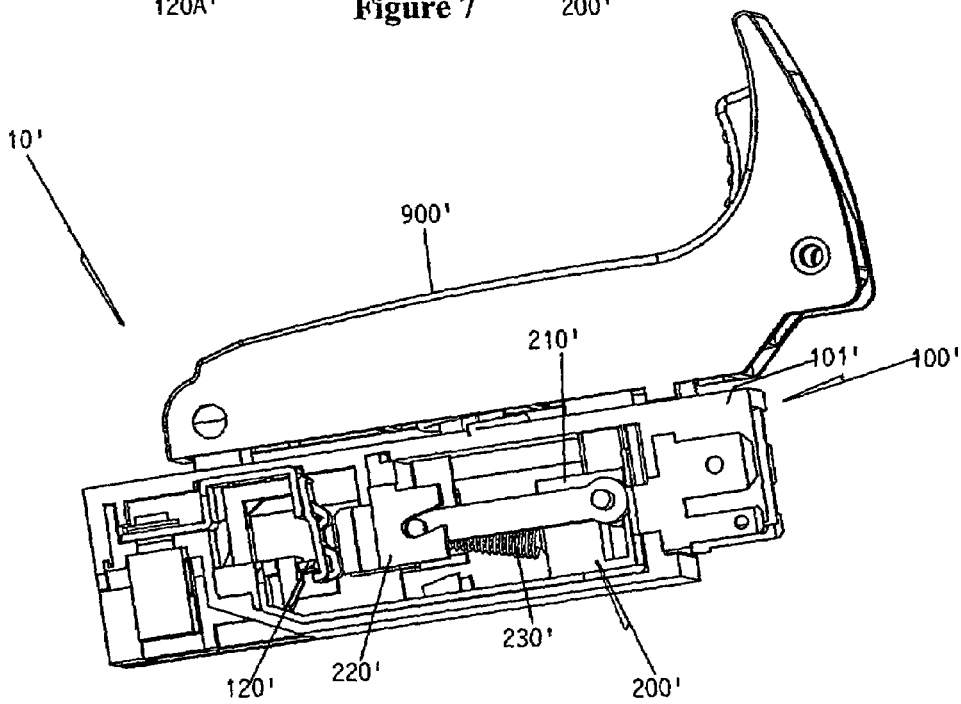
FIG. 8 is a perspective view of the switch of FIG. 6, partially broken to reveal the interior of the switch.

A coil spring 910 is compressed to co-act between the base 100 and the operator 900 at mid-length thereof to resiliently bias the operator 900 upwardly from the base 100 about the hinge block 102. The operator 900 is retained by an anchor 103 on the front casing portion 101A, such that at rest it is inclined outermost at a small angle of about 5° from the base 100 (FIG. 3). The operator 900 may be pressed towards the base 100, against the action of the spring 910, until it lies close to the base 100 (FIG. 4). Upon release, the operator 900 will be flicked by the spring 910 back to its outermost position.

A pair of opposed fixed contacts 120 and a moving contact lever 110 are arranged inside the rear portion 101B of the base casing 101, and an operating mechanism 200 in the front casing portion 101A. The contact lever 110 is supported for movement by the operating mechanism 200 between an ON position in contact with both fixed contacts 120 (FIG. 4) and an OFF position out of contact from the fixed contacts 120 (FIG. 3), whereby switching is performed.

The operating mechanism 200 is implemented by an operating member 210, a contact mover 220 and a spring-loaded device 230 provided between the operating member 210 and the contact mover 220.

The operating member 210 is a slider comprising a block 211 and a shaft 212 upstanding vertically therefrom.

Opposite left and right side walls of the block 211 have a pair of aligned vertical slots 213. The shaft 212 projects upwardly out of the base casing 101 as between the anchor 103 and the spring 910, and is loosely connected at its upper end to within the operator 900 by means of a horizontal hinge pin 214.

The block 211 is supported and guided by the base casing 101 for vertical linear sliding movement in opposite directions, at right angles to the longitudinal extent of the base 100, between a lower, ON position (FIG. 4) corresponding to the ON position of the contact lever 110 and an upper, OFF position (FIG. 3) corresponding to the OFF position of the contact lever 110.

By reason of its hinge connection with the operator 900, the operating member 210 is movable by or with the operator 900 such that it is normally at the upper, OFF position (FIG. 3). The operating member 210 will be slid downwards by the operator 900 as the latter is pressed, and will stay at the lower, ON position (FIG. 4) for as long as the operator 900 is pressed.

The contact mover 220 is another slider that has front, middle and rear parts 221, 222 and 223 respectively. By being supported and guided at its middle part 222 by the base casing 101, the contact mover 220 is arranged to be slidable linearly in opposite vertical directions between an upper, ON position (FIG. 4) corresponding to the ON position of the contact lever 110 and a lower, OFF position (FIG. 3) corresponding to the OFF position of the contact lever 110.

The front part 221 of the contact mover 220 has opposite left and right side walls which include a pair of aligned forward-facing recesses 227.

With its rear part 223 including a pair of upper and lower abutments 224 and 225 and a coil spring 226 compressed therebetween, the contact mover 220 carries the contact lever 110 by having it clamped at mid-length between the upper abutment 224 and the spring 226, at a position immediately below and in alignment with the two fixed contacts 120. The contact movers 220 slides upwards to bring the lever 110 into contact with the fixed contacts 120 (FIG. 4) and, alternately, downwards to detach the lever 110 from the fixed contacts 120 (FIG. 3).

The upper abutment 224 has a surface 224A bearing the contact lever 110, which is slightly inclined relative to the two fixed contacts 120 such that the lever 110 will make contact with a specific i.e. the left fixed contact 120 last (to complete a circuit) and, more importantly, break contact from the same fixed contact 120 first (to open a circuit). The left fixed contact 120 and the associated end of the lever 110 can then be improved for better contact performance e.g. protected by a platinum coating.

By reason of the contact lever 110 being resiliently inclined relative to the fixed contacts 120, there is always a tendency as caused by the spring 226 for the lever 110 to break away from at least one of the fixed contacts 120, such that unintended closing of the switch 10 in the case of malfunctioning may be avoided.

The operating member 210 acts upon the contact mover 220 by means of the spring-loaded device 230, which comprises a coil spring 231 and a U-shaped bracket 232 sprung by the spring 231. The bracket 232 acts as a pivotable link extending across the operating member 210 and the contact mover 220. More specifically, it has two opposed free ends hinged to the block 211 of the operating member 210 by means of a hinge pin 233 passing through the slots 213, and a U-bend hinged to the contact mover 220 by means of another hinge pin 234 passing through the recesses 227.

The spring 231 has one end acting upon a protuberance 215 on the block 211, and the other end acting upon the inner side of the U-bend of the bracket 232. By virtue of its resilience, the compressed spring 231 can be pivoted to flip from one side of the bracket 232 to its opposite side, or vice versa, through a sudden over-center action past a transitional condition of maximum compressive strain in the spring 231 i.e. when the spring 231 is instantaneously at its shortest length in the plane of the bracket 232.

In a different embodiment, conversely, the bracket 232 can be pivoted to flip across opposite sides of the spring 231 through an over-center action past the transitional condition of maximum strain in the spring 231. Further, the spring 231 may be pre-stretched, in which case the transitional condition is concerned with maximum tensile strain or tension in the spring 231.

The arrangement is such that the contact mover 220 can be flicked by the operating member 210 to the opposite position, or between its ON and OFF positions as the operating member 210 is slid back-and-forth.

In operation, a user presses the operator 900 to push the operating member 210 inwardly of the base casing 101 to its lower position (from FIGS. 3 to 4). Upon lowering of the operating member 210, its block 211 pivots the spring 231 downwards without disturbing the bracket 232, which is skipped via the slots 213. As the spring 231 is flipping across to the opposite lower side of the bracket 232, the bracket 232 flips upwards in the opposite direction by reaction, whereupon the contact mover 220 is flicked or jerked to its upper position bringing the contact lever 110 into contact with the fixed contacts 120, whereby the switch 10 is closed.

The switch condition will maintain until the user releases the operator 900, whereupon the operating member 210 is pulled by the spring 910 outwardly of the base casing 101 back to its original upper position (from FIGS. 4 to 3) and simultaneously, through reversal of the actions described in the preceding paragraph, the contact mover 220 is flicked to its lower position detaching the contact lever 110 from the fixed contacts 120, whereby the switch 10 is opened.

Reference is now made to FIGS. 5 to 8, which show a second electrical switch 10' embodying the invention, which has generally the same construction and operates in generally the same way as the first electrical switch 10 described above except as described below, with equivalent parts designated by the same reference numerals suffixed by an apostrophe sign. The major difference lies in the construction and operation of the moving and fixed contacts 110' and 120' (now denoted separately as lower and upper fixed contacts 120A' and 120B') and the rear part 223' of the contact mover 220'.

In this embodiment, apart from having a more complicate design as shown, the contact lever 110' is pivoted about the lower fixed contact 120A' as a fulcrum for rocking movement by the contact mover 220' between an ON position in contact with upper fixed contact 120B' (FIGS. 6 and 8) and an OFF position out of contact from the upper fixed contact 120B' (FIGS. 5 and 7), whereby switching is performed.

The contact mover 220' manipulates the contact lever 110' by means of a plunger 224' which is resiliently biased outwards from the rear mover part 223' by an internal compression coil spring 226'. With the contact mover 220' being likewise slidable upwards and downwards by an identical operating mechanism 200', the spring-loaded plunger 224' bears at right angles against the lever 110' while sliding laterally along it in opposite directions across opposite sides of the fulcrum (i.e. the lower fixed contact 120A') to thereby pivot the lever 110' to make or break contact with the upper fixed contact 120B'. This rocker-type switch in general permits a relatively wider contact separation for better insulation performance or current carrying capacity.

The contact lever 110' has two bumps (as shown) between which the plunger 224' slides back-and-forth. As the plunger 224' hits the relevant bump in either direction, it moves the lever 110' with it for a short distance, whereby the contacting surfaces of the lever 110' and the upper fixed contact 120B' are rubbed or wiped against each other. Such a wiping action results in self-cleaning of the contact points or areas to ensure good contact at all time.

In general, the aforesaid over-center action results in rapid or snap contact switching which is preferred, especially for switching off an inductive circuit such as one that involves an electric motor in a power tool, as it will avoid the occurrence of undesirable contact flashover and/or welding or at least minimise their damage caused to the switch contacts.

In another aspect, the over-center action will introduce a short delay in time from the moment the switch operator is triggered to the moment switching actually takes place, as is required before the spring pivots and reaches its unstable condition of maximum strain or tension. Such a time delay is useful to avoid unintentional or accidental actuation of the switch.

It should be noted that switching is effected indirectly via an intermediate component (i.e. the aforesaid contact mover) which is actuated by the over-center action to in turn move the moving contact relative to the fixed contact(s) employing a separate switching action. This allows the choice of a suitable switching action to meet other criteria, such as safety and contact self-cleaning in the case of the described embodiments.

The invention has been given by way of example only, and various other modifications of and/or alterations to the described embodiments may be made by persons skilled in the art without departing from the scope of the invention as specified in the appended claims.

What is claimed is:

1. An electrical switch comprising:

a casing;

at least one fixed contact and at least one moving contact supported in the casing for movement between an ON position in contact with the fixed contact and an OFF position out of contact with the fixed contact; and an operating mechanism located in the casing for moving the moving contact between the ON position and the OFF position, the operating mechanism comprising:

an operating member supported for movement between an ON position corresponding to the ON position of the moving contact and an OFF position corresponding to the OFF position of the moving contact;

a contact mover supported for moving the moving contact upon movement by the operating member, between an ON position corresponding to the ON position of the operating member and an OFF position corresponding to the OFF position of the operating member; and a spring-loaded device located between the operating member and the contact mover for movement by the operating member past a transitional condition of maximum strain to flick the contact mover between the ON and OFF positions of the contact mover, the spring-loaded device comprising a spring compressed or stretched between the operating member and the contact mover, and a pivotable link extending across the operating member and the contact member, the link being acted upon by the spring.

2. The electrical switch as claimed in claim 1, wherein the operating member is supported for linear movement in opposite directions.

3. The electrical switch as claimed in claim 2, wherein the operating member is supported for movement inwardly and outwardly of the casing.

4. The electrical switch as claimed in claim 1, wherein the contact mover is supported for linear movement in opposite directions.

5. The electrical switch as claimed in claim 4, wherein the operating member is supported for linear movement in opposite directions, substantially parallel to the movement of the contact mover.

6. The electrical switch as claimed in claim 1, wherein the spring-loaded device performs an over-center action, past the transitional condition of maximum strain, upon movement by the operating member to flick the contact mover between the ON and OFF positions of the contact mover.

7. The electrical switch as claimed in claim 1, wherein the spring is flippable across opposite sides of the link through an over-center action past the transitional condition of maximum strain in the spring.

8. The electrical switch as claimed in claim 1, wherein the link comprises a U-shaped member.

9. The electrical switch as claimed in claim 1, including two fixed contacts and the moving contact is separate from the two fixed contacts, the moving contact being carried by the contact mover for movement into contact with the two fixed contacts and out of contact with the two fixed contacts.

10. The electrical switch as claimed in claim 9, wherein the contact mover includes a spring and the contact mover supports the moving contact under action of the spring at an inclined position relative to the two fixed contacts.

11. The electrical switch as claimed in claim 1, including two fixed contacts and the moving contact pivots upon a first of the two fixed contacts for rocking movement by the contact mover into contact with a second of the two fixed contacts and out of contact with the second fixed contact.

12. The electrical switch as claimed in claim 11, wherein the contact mover includes a spring-loaded plunger acting upon the moving contact in opposite directions across one of the two fixed contacts.

* * * * *